United States Patent [19]

Yates et al.

[11] 4,101,993

[45] Jul. 25, 1978

[54] WIRE SPRING ASSEMBLY AND COMPONENTS

[75] Inventors: Chester Robert Yates, Carthage, Mo.; Guy E. Hall, Riverside, Calif.

[73] Assignee: Steadley Company, Inc., Carthage, Mo.

[21] Appl. No.: 770,799

[22] Filed: Feb. 22, 1977

[51] Int. Cl.[2] ..... A47C 23/04

[52] U.S. Cl. ..... 5/267; 5/264 B; 5/263

[58] Field of Search ..... 5/247, 248, 256, 260, 5/263, 267

[56] References Cited

U.S. PATENT DOCUMENTS

| | | | |
|---|---|---|---|
| 207,833 | 9/1878 | Van Sickle | 5/264 B |
| 248,133 | 10/1881 | Buell | 5/264 B |
| 3,789,440 | 2/1974 | Garceau | 5/267 |
| 3,825,960 | 7/1974 | Inman | 5/260 |
| 3,914,809 | 10/1975 | Ciampa et al. | 5/264 B |

*Primary Examiner*—Casmir A. Nunberg
*Attorney, Agent, or Firm*—Sheridan, Ross, Fields & McIntosh

[57] ABSTRACT

The entire assembly includes an upper supporting panel, a base, and spring body means between the panel and base. The panel comprises a rectangular border frame and a grid made up of a series of grid wires extending longitudinally and another series extending laterally to define rows of rectangular openings serving as spring seats. The spring body means comprise coil spring bodies and attachment heads made up of single lengths of wire. The heads are bent to U-shape with a rectangular pattern similar in size and shape to the spring seats, and portions are offset to resiliently grip the grid wires defining a selected spring seat above and below the grid and lock the head in place. The rectangular engagement of the spring components with the spring seats prevents rotation in their mountings.

19 Claims, 15 Drawing Figures

WIRE SPRING ASSEMBLY AND COMPONENTS

BACKGROUND OF THE INVENTION

This invention lies in the field of wire spring assemblies such as those which form the foundation of a box spring used for supporting a mattress. It is directed to the construction and interconnection of components and more particularly to the construction of coil springs having attachment heads which are shaped for detachable connection to a wire grid by flexing movement without the use of special tools and resiliently grip the grid to lock them in place and prevent rotational movement.

The usual commerical methods of building box springs include building a mesh or wire grid having a wire border member and connectng individual coil springs to the grid, connecting the assembly to a base, and applying suitable padding and covering material. The springs are connected to the grid by welding, tying, wire twisting, clipping etc. while connections of this type have generally produced rather satisfactory spring assemblies they are subject to loosening, except for welded connections, and wear resulting in failure. In addition, they all require special machinery or tools and a great deal of hand labor all of which in recent years have added greatly to the cost of manufacture.

To overcome these disadvantages various schemes have been proposed for connecting springs to a mesh or grid without extraneous devices by distorting the coils or the grid wires to interengage resiliently and to secure the coils in position by elastic opposing forces between the interengaged parts. Examples of such schemes may be found in such U.S. Pat. Nos. as 1,871,440 to Barnard, 3,660,854 to Garceau, 3,761,972 to Bihun et al, and 3,766,578 to Toupal. While these various schemes greatly decrease the manual labor involved and hence improve the total manufacturing cost picture, they also introduce new problems and disadvantages.

In one class of such improved structures of grid wires are distorted or offset in various ways to provide seats or nests for the circular ends of the spring coils. This requires a great deal of machine forming work on the grid wires, and the formed portions must be very accurately located in the grid to cooperate with each other and produce correct nests in the proper places. Since the spring coil ends are circular it is possible for them to rotate even though elastic gripped. Changes in position lead to wear and failure.

In another class of such improved structures, the crossing grid wires are not positively secured to each other, as by welding, but spring coil ends are specially formed to engage both wires at a crossing point, both to secure the spring to the grid and to tie the wires together at the crossing point. The limited elastic grip cannot positively lock the wires together, and varying and repeated loads cause them to slide on each other, producing wear and displacement from their design locations. The spring coils themselves are not centered under the points of load application. The eccentric loading makes the coil less than fully effective, and tends to distort it out of shape and cause early breakdown.

SUMMARY OF THE INVENTION

The construction of the present invention overcomes the disadvantages mentioned above and provides a foundation which requires minimum assembly labor and no special tools and insures positive anchoring of the spring coil ends to the grid against removal and rotation.

Generally stated, an upper mat is provided which is formed in conventional manner with a rectangular border frame having elongate side and end border members and a load supporting wire grid comprising spaced parallel grid wires extending longitudinally and laterally and crossing over each other, and secured to the border frame and to each other to define lateral and longitudinal rows of adjacent rectangular openings. The spring component in one form comprises a generally coil-shaped vertically extending spring body and an attachment head at the top of the body, all formed of a single length of resilient wire.

The attachment head lies substantially in a horizontal plane and includes at least three lengths of wire bent at right angles to each other to form a general U-shape having a generally rectangular planform together with integral wire corner sections connecting the lengths to each other and to the spring body. Portions of the head are vertically offset from each other to overlie at least two grid wires extending in one direction and to underlie at least two grid wires extending in another direction.

Since the head is formed of resilient wire it may be sprung out of its shape of repose and fitted in place to underlie and overlie the grid wires. When it is released it resiliently engages four grid wires at four rectangularly arranged points and resists vertical displacement and also rotational displacement and is therefore securely locked in predetermined position.

The spring coil is centered under the rectangular opening or spring seat to which the head is attached and hence there is no eccentricity of loading when the assembly is in use. Each coil terminates at its lower end in an attachment section extending across the vertical axis of the coil, and the attachment section is provided with a V-shaped offset to receive a staple for connection to a wood base or a cross wire for connection to a wire grid base.

The attachment head may be used with a conventional round coil spring or with a rectangular coil spring, the latter being preferred. The coil has a rectangular planform pattern substantially the same as that of the head. All of the straight lengths of wire from top to bottom are sequentially downwardly angled to operate in torsion and produce a continuous torsion coil spring. This is contrary to present practice in which the successive lengths are alternately downwardly angled and horizontal for the express purpose of using the downwardly angled lengths as levers and putting all of the torsional stresses in the horizontal length. Such arrangement overstresses the horizontal length and greatly increases the likelihood of failure.

An important advantage of the present construction is that a standard straight wire flat grid can be used and spring can be inserted in any number of seats in any arrangement desired by a customer without any special engineering or design work.

BRIEF DESCRIPTION OF THE DRAWINGS

Various other advantages and features of novelty will become apparent as the description proceeds in conjunction with the accompanying drawings, in which.

DESCRIPTION OF PREFERRED EMBODIMENTS

Figure 1:
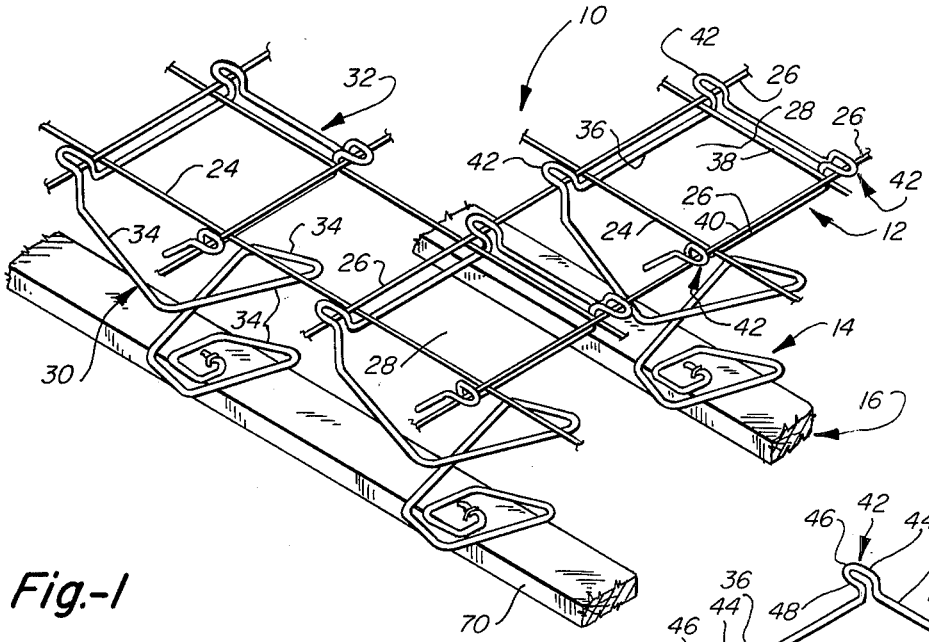
FIG. 1 is a fragmentary perspective view of a first form of the spring assembly.

A first form of the construction of the invention is schematically illustrated in FIG. 1, in which the spring assembly 10 includes an upper mat 12, a plurality of spring components 14 secured to and depending from the mat, and a base 16 to which the lower ends of the components are secured to make up a foundation.

Figure 3:
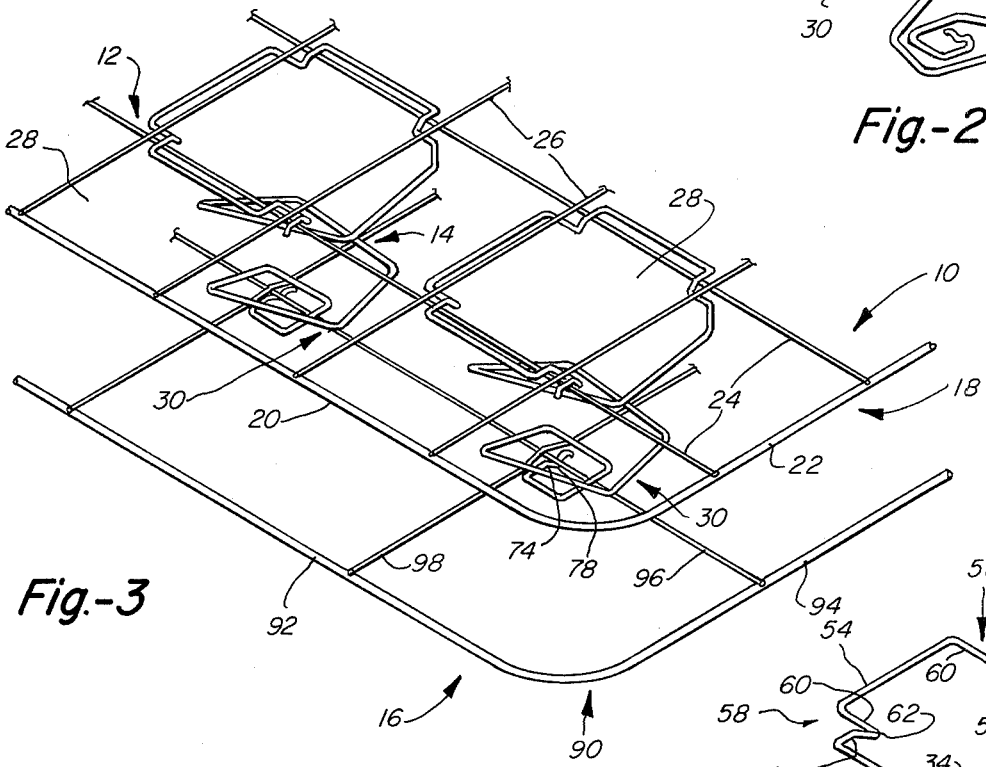
FIG. 3 is a fragmentary perspective view of a second form of the spring assembly.

The mat 12 is made up of a rectangular border frame 18 such as shown in FIG. 3, having elongate side and end border members 20 and 22 and a load supporting wire grid comprising a first series of laterally spaced parallel grid wires 24 extending between the end border members and a second series of laterally spaced parallel grid wires 26 extending between the side border members and crossing the first series at right angles thereto. The grid wires are fixedly secured, as by welding, at their ends to the border members and to each other at their crossing points to define a substantially planar grid of lateral and longitudinal rows of adjacent rectangular openings, or spring seats 28.

The spring components 14 are formed of single continuous lengths of resilient wire having vertically extensive spring body means 30 and an attachment head 32. In this form, the spring body means comprises a single generally coil-shaped vertically extending body portion in which a succession of straight lengths of wire 34 are bent at right angles to each other to form a rectangular planform pattern and all of the lengths from top to bottom are successively downwardly angled to operate in torsion and produce a continuous torsioncoil spring. This is superior to other springs in which the successive lengths are alternately downwardly angled and horizontal, the angled lenths acting as levers and the horizontal lengths taking all of the torsional stress. In the present construction the torsional stress is distributed between all of the lengths.

Attachment head 32 at the top of the body member lies substantially in a horizontal plane and has a generally rectangular planform, and portions of the head are vertically offset from other portions to overlie two grid wires of one series and to underlie two grid wires of the other series. The portions resiliently grip the grid wires at opposite sides of the mat to detachably lock the head in place and prevent rotation in its mounting. The head is made up of at least a first bar 36, a second bar 38 extending laterally from bar 36, and a third bar 40 extending laterally from bar 38 in parallel spaced relation to bar 36 to form a U-shape of generally rectangular planform and integral wire corner sections 42 connecting the bars to each other and bar 36 to the body portion 30.

Figure 2:
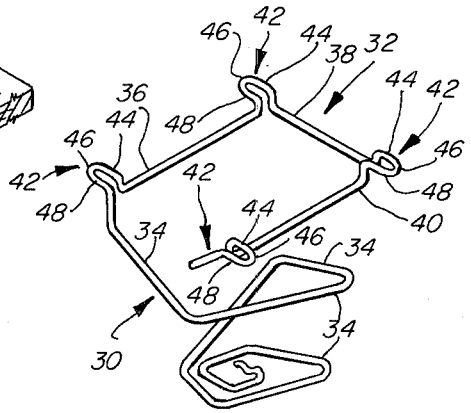
FIG. 2 is a perspective view of one of the components of the assembly.

As best seen in FIG. 2, the corner sections connecting bar 38 to bars 36 and 40 each includes a first portion 44 extending outward in the direction of bar 38, a second recurved portion 46, and a third portion 48 extending inward and offset vertically to meet the end of the adjacent bar. Bar 38 may be at the level of the corner sections or may be in the plane of the other two bars as shown, in which case portions 44 are also offset vertically as shown. The corner section connecting bar 36 to spring body means 30 is formed in the same way as the other corner sections. A similar corner section may be provided at the free end of bar 40 to complete the attachment form.

To secure the head to the grid as shown in FIG. 1, sections 42 at the ends of bar 36 are raised up under the grid and the head is swung to engage them over a wire 26. The head is then flexed to cause the section 42 between bars 38 and 40 to engage over the next wire 26. In the mounted position the bars are all located close to their respective grid wires and widely spaced from other grid wires in any direction. With bars 36 and 40 underlying successive wires 24 and the corner sections overlying successive wires 26 the head is locked against vertical movement and disengagement. The corner sections 42 lie outside the outline of the spring seat but close to wires 24 so that the combinations of bars and corner sections effectively prevents rotation of the head in its mounting. The total securing action is clearly shown in FIGS. 5, 6, and 7.

Figure 4:
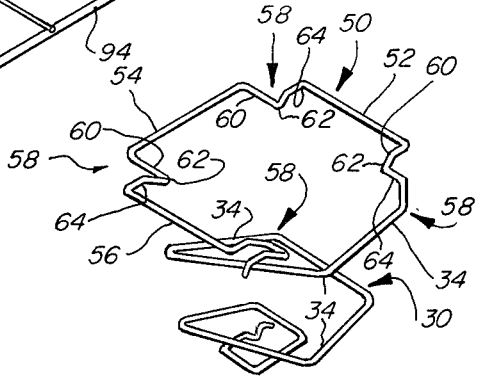
FIG. 4 is a perspective view of one of the components of the assembly of FIG. 3.
Figure 10:
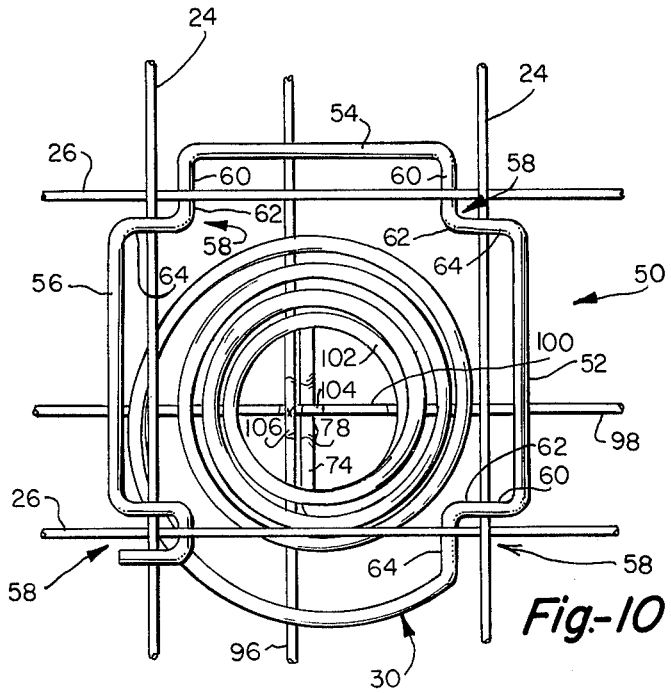
FIG. 10 is a plan view of one of the components of FIG. 3 mounted in place.
Figure 11:
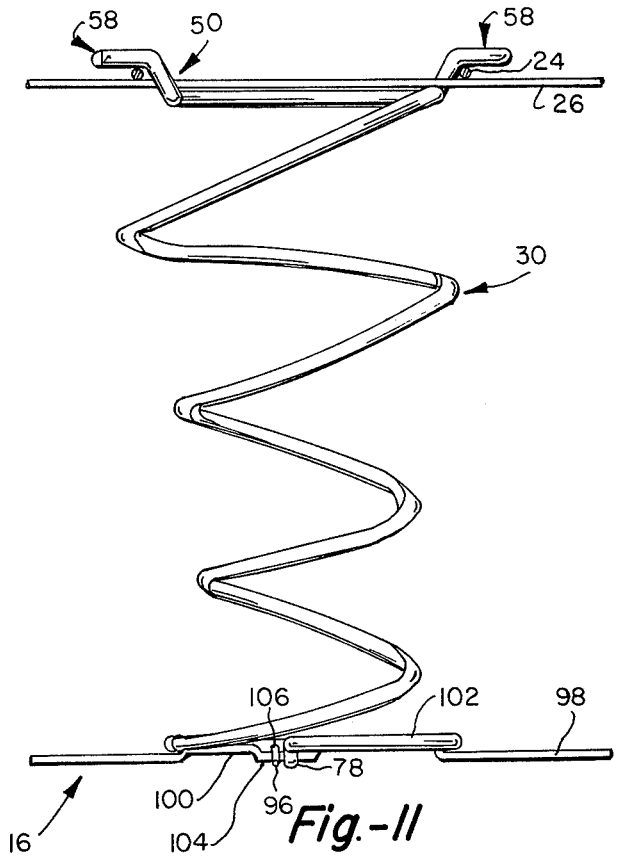
FIG. 11 is a front elevational view of the structure of FIG. 10.

The second form of construction is shown in FIGS. 3 and 4 and, with a variation, in FIGS. 10 and 11. In this form the spring body means 30 is the same as in the first form, and the attachment head 50 also includes at least a first bar 52, a second bar 54 extending laterally from bar 52, and a third bar 56 extending laterally from bar 54 in parallel spaced relation to bar 52 to form a U-shape of generally rectangular planform and integral wire corner sections 58 connecting the bars to each other and bar 52 to the body portion 30.

As best seen in FIGS. 4, 10, and 11, the first and third bars 52 and 56 lie in a common plane and the second bar 54 is displaced from but parallel to the common plane. The corner sections 58 connecting the second bar 54 to bars 52 and 56 each includes a first portion 60 extending laterally inward from the ends of bar 54, a second portion 62 offset vertically, and a third portion 64 extending laterally outward to meet the end of the adjacent bar. The corner section 58 connecting bar 52 to spring body means 30 includes a first portion 60 extending laterally inward from the end of bar 52, a second portion 62 offset vertically, and a third portion 64 extending laterally outward to meet the upper end of the spring body means. A similar corner section may be provided at the free end of bar 56 to complete the attachment form.

To secure the head to the grid as shown in FIG. 3, bar 56 is raised up under the grid and the head is swung to engage bar 56 over a wire 24 with the corner sections 58 engaging over the wire and under the two wires 26 of the spring seat. The head is then flexed to bring bar 52 within the outline of the spring seat and then up and over the next wire 24. The corner sections extend up and down inside each of the corners of the spring seat, bars 52 and 56 with portions of the corner sections overlie successive grid wires 24, and bar 54 with portions of the corner sections underlies a wire 26. The bars are all close to their respective grid wires and widely spaced from all other grid wires in any direction. The head is locked in place against vertical displacement and detachment and against rotation in substantially the same way as in the first form by virtue of the rectangular interengagement between the head and the grid wires.

A conventional round spring coil is illustrated in FIGS. 10 and 11. It is apparent that such a coil may be used in any of the components disclosed herein.

Since all of the grid wires are welded together at their crossing points the upper offset portions of the head may overlie the grid wires of either series without dislocating them, but it is preferred to locate the heads as shown in order to apply compressive force to all of the welded joints rather than a separating force. In addition, such arrangement serves to maintain the wires in design position in the event of failure of a welded joint.

Since the spring seats are uniform in size and shape and both forms of head fit the same spring seats, it is possible to use either component in any assembly and to install as many as desired by the customer in any location to achieve varying load supporting effects. It will be noted that, with the form of FIGS. 3, 4, 10 and 11, two components may be mounted in adjacent spring seats by rotating one component ninety degrees about its vertical axis. Considering FIG. 10 for example, a second head 50 may be inserted in the spring seat to the right of the one shown, with bar 54 of the second head underlying bar 52 of the first head and its adjacent grid wire 24 and with bars 52 and 56 overlying grid wires 26.

Figure 12:
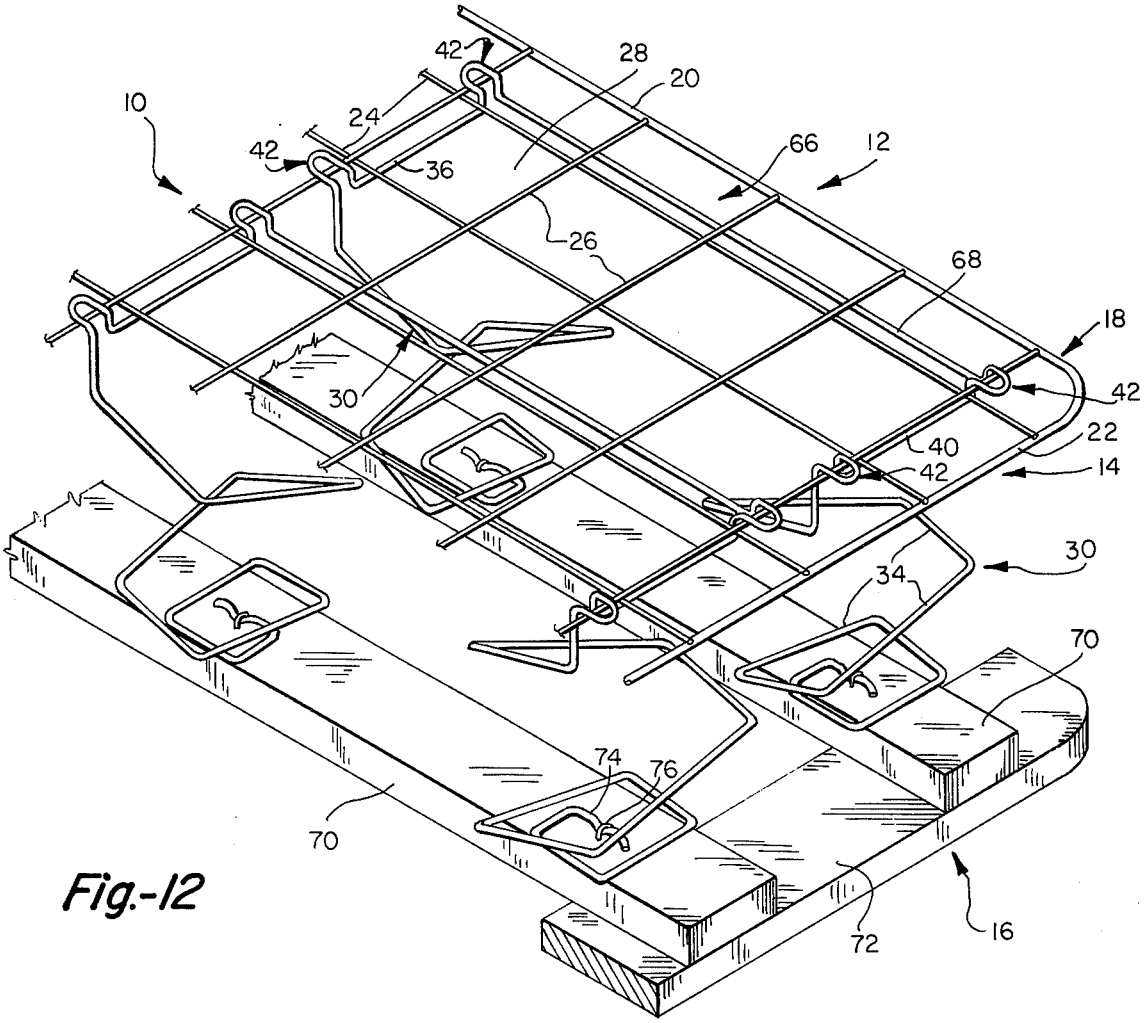
FIG. 12 is a fragmentary perspective view of a third form of the spring assembly.
Figure 13:
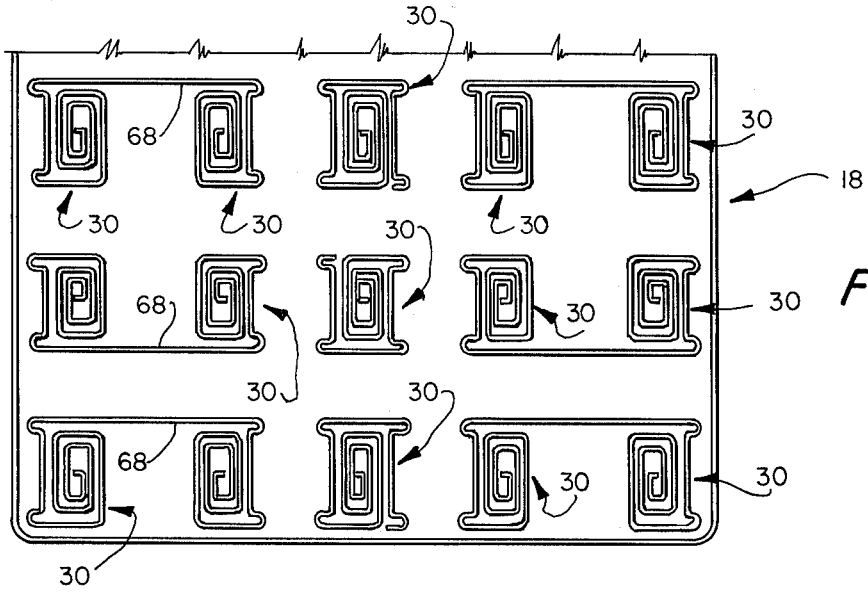
FIG. 13 is a fragmentary plan view showing an assembly with two different forms of components.
Figure 14:
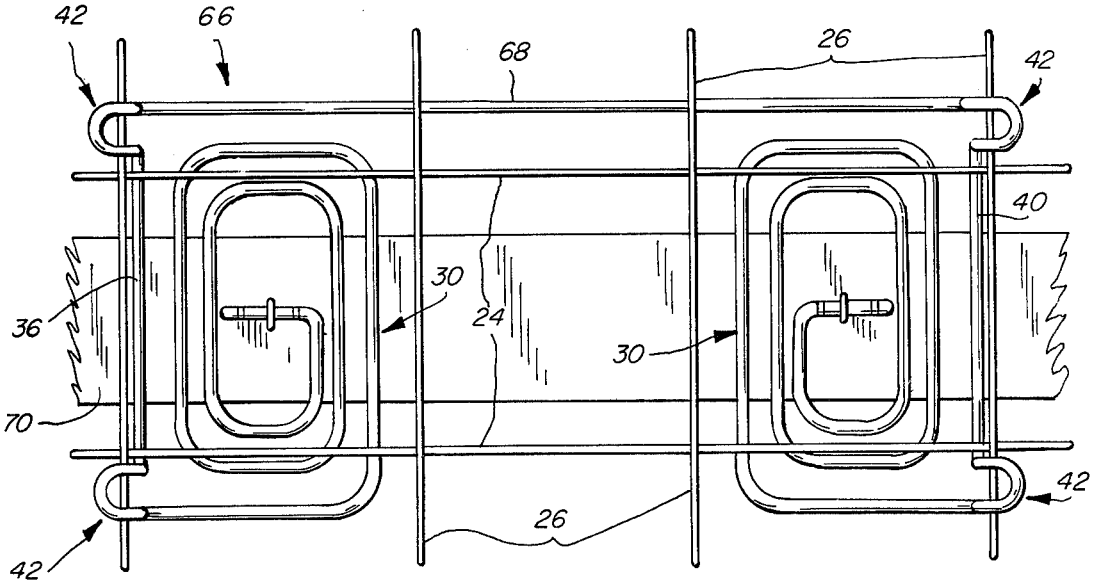
FIG. 14 is a fragmentary plan view of one of the components of FIG. 12 mounted in place.
Figure 15:
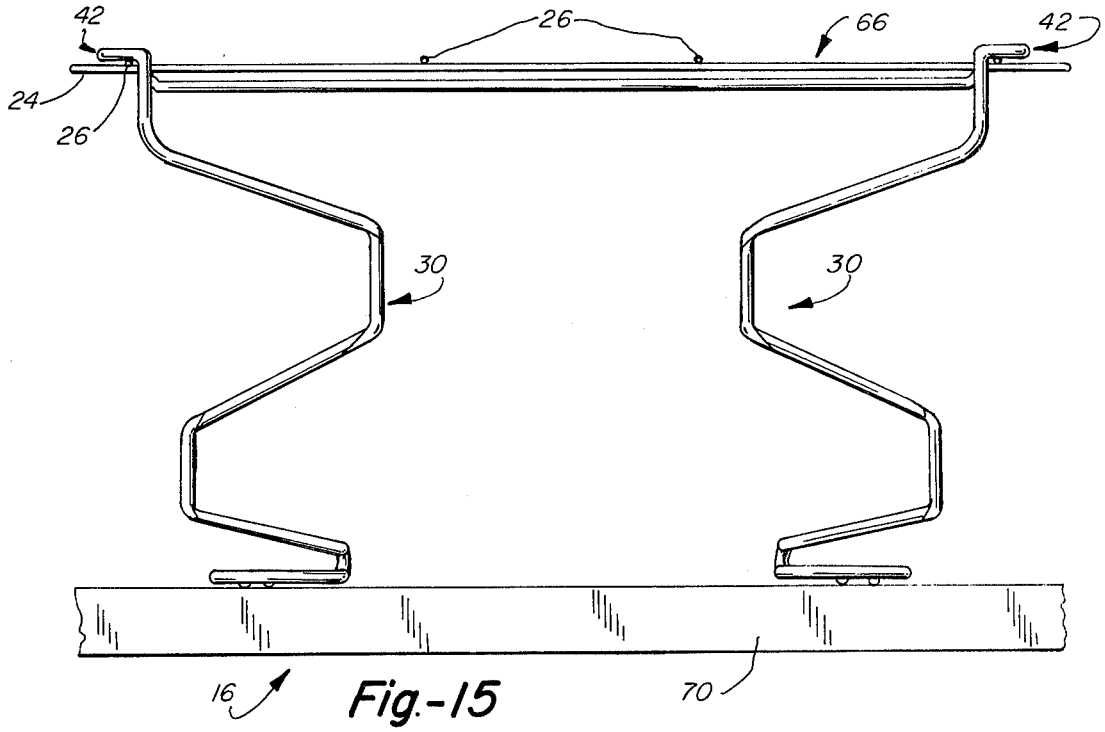
FIG. 15 is a front elevational view of the structure of FIG. 14.

A third form of construction is shown in FIGS. 12, 14, and 15, and represents a modification of the first form. The attachment head 66 includes first and third bars 36 and 40 which are the same as those of FIGS. 1 and 2, together with a second bar 68 which is similar to bar 38 but its longitudinal extent spans three spring seats instead of one. The three bars are connected in the same way by corner sections 42. In this case the spring body means includes two spring body members 30 coiled in opposite directions. The first member 30 is connected to the first bar 36 by a corner section 42 as before and the second member 30 is connected to the third bar 40 by another corner section 42. Although bars 36 are spaced farther apart than in the first form the manner of attaching the head to the grid is the same. Bar 36 and its two corner sections 42 are brought up under the grid and the head is tilted to bring the corner sections over wire 26. Bar 68 is then sprung sufficiently to swing bar 40 into place in the same way. Bar 68 extends under the intervening grid wires 26. It is to be noted that the length of bar 68 may be selected so that the two spring body members 30 underlie adjacent spring seats or are spaced to leave one empty spring seat as shown in FIG. 14 or to leave two empty spring seats as shown in FIG. 12. The double coil components may be used separately or in conjunction with single coil components to produce varied patterns as indicated in FIG. 13.

Figure 5:
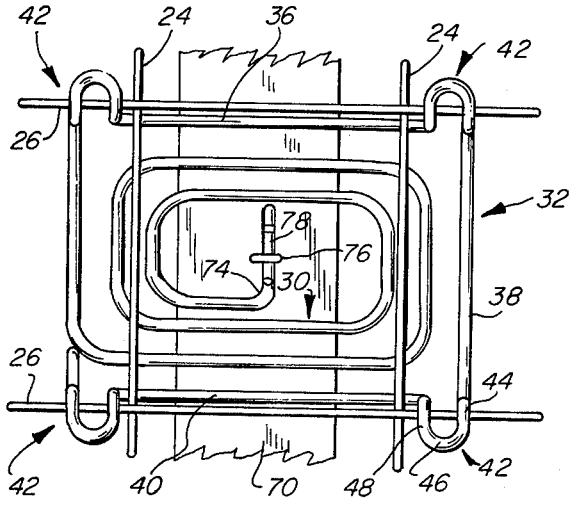
FIG. 5 is a plan view of one of the components of FIG. 1 mounted in place.
Figure 6:
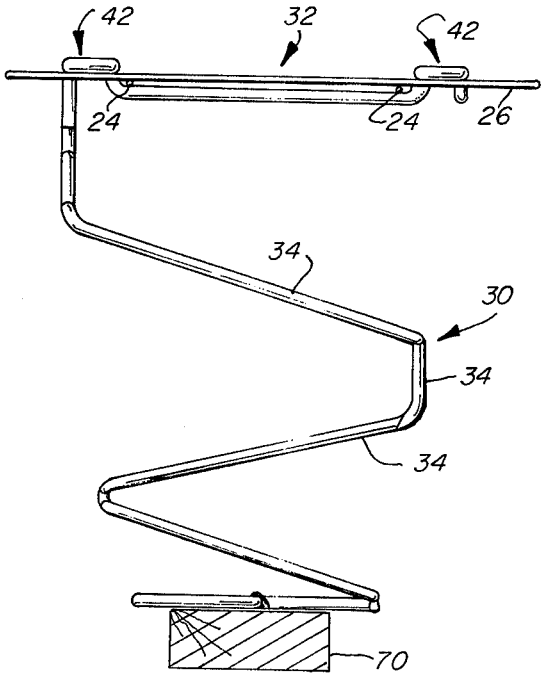
FIG. 6 is a front elevational view of the structure of FIG. 5.
Figure 7:
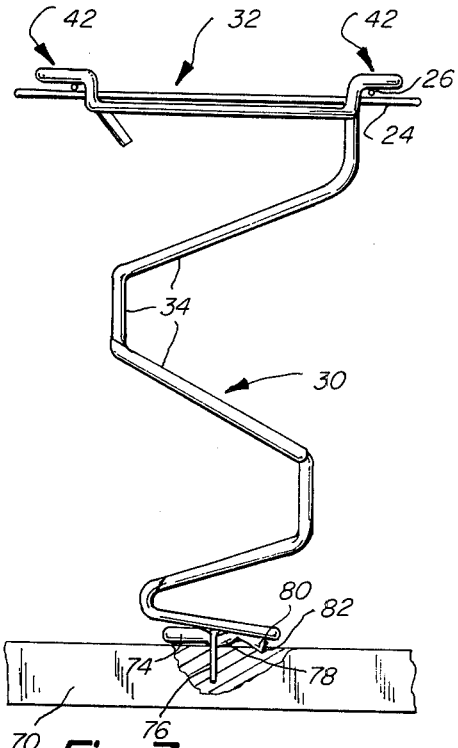
FIG. 7 is a side elevational view of the structure of FIG. 5.

With either type of spring coil the lower end is formed for secure attachment to a base. A portion of a typical wood base 16 is illustrated in FIG. 12 in which a plurality of longitudinal wood slats 70 are secured to a plurality of lateral wood slats 72 such as the one shown in this figure. An attachment section 74 at the bottom of each coil is fastened to a slat 70 by a staple 76. The connection is best illustrated in FIGS. 5 and 7 where it will be seen that attachment section 74 is a continuation of the wire of the coil and extends across the vertical axis of the body portion. It is formed with a V-shaped offset 78 which is bridged by staple 76 and driven slightly into the wood. The end 80 of the attachment section extends downward and is cut off to present a sharp point 82 which penetrates the wood when the staple is driven home and thus prevents rotation of the lower end of the body portion. Since the staple is substantially on the axis of the coil it greatly facilitates the application present a sharp point 82 which penetrates the wood when the staple is driven home and thus prevents rotation of the lower end of the body portion. Since the staple is substantially on the axis of the coil it greatly facilitates the application of a staple gun.

Figure 8:
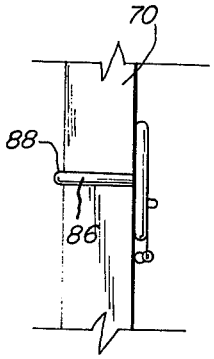
FIG. 8 is a side view of a modified attachment section at the lower end of a spring coil.
Figure 9:
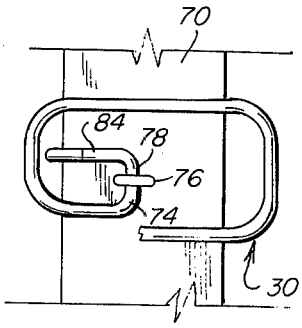
FIG. 9 is a plan view of the structure of FIG. 8.

For even greater security the attachment section may be modified as shown in FIGS. 8 and 9, in which it is formed with a first portion 84 which extends across the slat to its margin, a second portion 86 which extends down the side wall, and a third portion 88 which extends back under the slat. When it is mounted in place and fastened with staple 76 the attachment section is anchored against both vertical displacement and rotation and protects the staple against loosening.

The attachment section 74 may also be used to connect the coils to a lower wire grid which may be a temporary support for shipping purposes or the grid of a permanent base mat. As seen in FIG. 3, the base includes a border frame 90 having side and end border members 92 and 94 and longitudinal and lateral grid wires 96 and 98 attached to the border members and arranged similarly to those in the upper mat except that their crossing points are at the axes of the coils. Wires 96 extend beneath and in contact with the bottom coils of members 30 and overlie offsets 78 while wires 98 extend beneath and in contact with the bottom coils of members 30 and overlie wires 96 to lock the coils in predetermined spaced relation.

If it is desired to provide further security against lateral displacement of the lower ends of the coils, the base wires may be modified as shown in FIGS. 10 and 11. Wire 98 is formed with an upward offset 100 to fit within the bottom coil 102 and prevent movement along wire 98. It may be further provided with a central downward offset 104 pressing down into offset 78 of the attachment member. Wire 96 is formed with a V-shaped upward offset 106 overlying downward offset 104 of wire 98 to prevent movement along wire 96. Thus the coil is held against movement in either direction with respect to wire 98 and the latter is held against movement with respect to wire 96.

What is claimed is:

1. A wire spring assembly comprising:

a rectangular border frame having elongate side and end border members;

a first series of laterally spaced parallel grid wires extending between the end border members;

and a second series of laterally spaced parallel grid wires extending between the side border members and crossing the first series of wires at right angles thereto;

the two series of wires being fixedly connected at their ends to the border members and to each other at their crossing points to define a substantially planar grid of lateral and longitudinal rows of adjacent rectangular openings;

and a plurality of resilient wire spring components, each formed of a single length of wire, detachably connected to and depending from the grid;

each component including vertically extensive spring body means and an attachment head;

the attachment head lying substantially in a horizontal plane and having a generally rectangular planform;

and portions of the head being vertically offset from other portions to overlie two grid wires of one series and to underlie two grid wires of the other series;

the portions resiliently gripping the grid wires to detachably lock the head in place and prevent rotation in its mounting.

2. An assembly as claimed in claim 1; in which the head includes at least a first bar, a second bar extending laterally from the first bar, and a third bar extending laterally from the second bar in parallel spaced relation to the first bar to form a U-shape of generally rectangular planform and integral wire corner sections connecting the bars to each other and to the spring body means.

3. An assembly as claimed in claim 2; in which the first and third bars extend substantially parallel to the grid wires in one series and the second bar extends substantially parallel to the grid wires in the other series.

4. An assembly as claimed in claim 3; in which the bars are located in proximity to their respective grid wires and widely spaced from successive grid wires in any direction.

5. An assembly as claimed in claim 4; in which the corner sections are displaced out of the planes of the bars to which they are connected to produce gripping contact with the grid wires at the upper and lower sides of the grid.

6. An assembly as claimed in claim 4; in which the first and third bars are located within the outline of a selected spring seat and the second bar is located outside of the outline of the selected spring seat.

7. An assembly as claimed in claim 4; in which all of the bars are located outside of the outline of a selected spring seat.

8. An assembly as claimed in claim 4; in which the first and third bars are located within the outlines of separate selected spring seats and the second bar is located outside of the outlines of both spring seats.

9. An assembly as claimed in claim 4; in which the spring body means comprises a single generally coil-shaped vertically extending body portion;

and one of the corner sections connects the body portion to the first bar of the attachment head.

10. An assembly as claimed in claim 4; in which the spring body means comprises two generally coil-shaped vertically extending body portions;

one of the corner sections connects one body portion to the first bar of the attachment head;

and one of the corner sections connects the other body portion to the third bar of the attachment head.

11. An assembly as claimed in claim 1; in which a base of wood slats is provided, spaced below and parallel to the wire grid;

the spring body means comprise generally coil-shaped vertically extending body portions terminating at their lower ends in attachment sections extending across the vertical axes of the body portions;

each attachment section is formed with a V-shaped offset;

and a staple is fixed in the underlying wood slat with its bail overlying the offset;

the end of the attachment section having a formation to engage the slat and prevent rotation of the lower end of the body portion.

12. An assembly as claimed in claim 11; in which the end of the attachment section extends downward to enter into the wood slat when the staple is driven home to anchor the attachment section against rotation.

13. An assembly as claimed in claim 11; in which the end of the attachment section extends across the wood slat, down over its margin, and back under the slat to anchor the attachment section against rotation and vertical displacement.

14. An assembly as claimed in claim 1; in which the spring body means comprise generally coil-shaped vertically extending body portions terminating at their lower ends in attachment sections extending across the vertical axes of the body portions;

each attachment section is formed with a V-shaped offset;

a series of base wires extend in parallel spaced relation beneath the bottom coils of aligned body portions and overlying the V-shaped offsets;

and another series of base wires extend in parallel spaced relation at right angles to the wires of the first series beneath the bottom coils of the body portions and overlying the base wires of the first series to lock all of the body members in predetermined spaced relation.

15. A wire spring component for attachment to an upper, load supporting, wire grid comprising spaced, parallel, grid wires extending laterally and longitudinally and secured to a border frame to define lateral and longitudinal rows of adjacent rectangular openings, the component comprising:

vertically extensive spring body means and an attachment head at the top of the body means, all formed of a single length of resilient wire;

the attachment head lying substantially in a horizontal plane and having a generally rectangular planform;

the head including at least a first bar, a second bar extending laterally from the first bar, and a third bar extending laterally from the second bar in parallel spaced relation to the first bar to form a U-shape of generally rectangular planform and integral wire corner sections connecting the bars to each other and to the spring body means;

and portions of the head being vertically offset from other portions to overlie at least two grid wires extending in one direction and to underlie at least two grid wires extending in another direction to resiliently and detachably secure the component to a grid.

16. A component as claimed in claim 15; in which the first and third bars lie in a common plane and the second bar is displaced from but parallel to the common plane;

the corner sections connecting the second bar to the first and third bars each includes a first portion extending laterally inward from the ends of the second bar, a second portion offset vertically, and a third portion extending laterally outward to meet the end of the adjacent bar;

and the corner section connecting the first bar to the spring body means includes a first portion extending laterally inward from the end of the first bar, a second portion offset vertically, and a third portion extending laterally outward to meet the upper end of the spring body means.

17. A component as claimed in claim 15; in which the corner sections connecting the second bar to the first and third bar each includes a first portion extending outward in the direction of the second bar, a second recurved portion, and a third portion extending inward and offset vertically to meet the end of the adjacent bar;

and the corner section connecting the first bar to the spring body means includes a first portion extending outward laterally of the first bar, a second recurved portion, and a third portion extending inward and offset vertically to meet the upper end of the spring body means.

18. A component as claimed in claim 15; in which the second bar is substantially longer than the first and third bars;

and the spring body means comprises a first vertically extending body portion connected to and depending from the first bar and a second vertically extending body portion connected to and depending from the third bar.

19. A component as claimed in claim 15; in which the spring body means comprises at least one vertically extending coil-shaped body portion;

the coil shape being defined by a succession of straight lengths of wire bent at right angles to each other to form a rectangular planform pattern;

all of the lengths from top to bottom being downwardly angled to operate in torsion and produce a continuous torsion coil spring.

* * * * *